US005512735A

United States Patent [19]

Hashimoto

[11] Patent Number: 5,512,735

[45] Date of Patent: Apr. 30, 1996

[54] ELECTRIC COOKING RANGE HAVING NEW SAFETY FEATURES

[75] Inventor: Hiroyuki Hashimoto, Osaka, Japan

[73] Assignee: Funai Electric Co., Ltd., Daito, Japan

[21] Appl. No.: 306,752

[22] Filed: Sep. 14, 1994

[30] Foreign Application Priority Data

Sep. 14, 1993 [JP] Japan ..... 5-252495
Dec. 6, 1993 [JP] Japan ..... 5-339746

[51] Int. Cl.[6] ..... H05B 6/68

[52] U.S. Cl. ..... 219/723; 219/722; 200/50.32

[58] Field of Search ..... 219/722, 723, 219/724; 200/50 R, 50 C, 50 A

[56] References Cited

U.S. PATENT DOCUMENTS

| | | | |
|---|---|---|---|
| 3,739,110 | 6/1973 | Constable | 200/5 R |
| 3,816,688 | 6/1974 | Fritts | 219/723 |
| 3,872,277 | 3/1975 | Niu | 219/715 |
| 4,321,445 | 3/1982 | Kristof et al. | 219/724 |
| 4,539,453 | 9/1985 | Miyazaki et al. | 219/722 |
| 4,556,773 | 12/1985 | Yoshiyuki et al. | 219/723 |
| 5,132,503 | 7/1992 | Lee | 219/723 |

*Primary Examiner*—Philip H. Leung
*Attorney, Agent, or Firm*—Lackenbach Siegel Marzullo Aronson & Greenspan

[57] ABSTRACT

To improve the safety of the interlocking switch circuit comprising a monitor switch, primary switch and secondary switch which are on/off by the opening and closing of the electronic range door in order to control the operation/nonoperation of the microwave generation device of the electronic range. The above switches are taken as relay contact points respectively, so as to be able to operate the on/off of each switch from outside. By this, the detection jig is decreased, the detection time period is also shortened and a cause of the safety decreases due to the increase of the efficiency removed. In addition, the switch which turns the on/off of the microwave generation device of the electronic range is adapted to increase the safety of the interlocking switch circuit by being arranged independently.

2 Claims, 7 Drawing Sheets

ELECTRIC COOKING RANGE HAVING NEW SAFETY FEATURES

2. BACKGROUND OF THE INVENTION

This invention relates to an electronic cooking range having a door interlocking switch circuit for controlling a microwave generation device of the electronic cooking range safely, the interlocking switch circuit of said electronic range enabling an increase in efficiency of examination time, constituting switches for opening and closing mechanism of doors with low capacity switches, thereby improving safety.

FIG. 9 is a perspective view of the electronic cooking range 15, wherein 10 is a door, 16 is a microwave generation device provided therein, 17 is a cooling fan, and 18 is a power transformer. FIG. 10 shows a main part of a section taken on line 10—10 in FIG. 9 and indicates an interlocking switch circuit mechanism at the inside of the door 10. Generally, the interlock switch circuit is provided with three switches, a monitor switch 1 at connected point b, a primary switch 2 at connected point a, and a secondary switch 3 at connected point a.

In this case, the monitor switch 1 among them a switch which informs a CPU (central processing unit) of a detection of the opening or closing of the door 10 and is adapted to operate prior to operations of the primary switch 2 and the secondary switch 3. In other words, the monitor switch 1 is constituted to open before the primary switch 2 and the secondary switch 3 open when the door 10 is closed, and to close after said primary switch 2 and the secondary switch 3 close when the door 10 is opened. The primary and the secondary switches 2 and 3 are, respectively, safety switches on power supply line and detect the opening and closing of the door 10 through an inner and circuit. Thus, the interlocking switch circuit of the electronic range is opened or closed mechanically in a certain order when the door of the electronic range opens or closes for maintaining safety at the time of its use.

In FIG. 10, the operation thereof is as follows.

When the door is closed, a hook link 4 urges a button 1A through an arm 11 of the monitor switch 1 by a lower top end 4B thereof, whereby the monitor switch 1 is on (the door opens) at first. Then, when the button 2A is urged by the top end 4 of the hook link 4, the primary switch 2 is on (the door closes) whereby the switch lever 12 rotates to urge a button 3A, thereby being on (the door is closed) the secondary switch 3. Reversely, when the door 10 is opened, the monitor switch 1 is on (the door opens) last after primary switch 2 and secondary switch 3 are off (the door opens). Thus, even if the switch does not work, the electronic range is separated from DC current completely to maintain safety. Further, 6 is a door-open lever, 7 is a door-open button and 8 is a spring.

FIG. 7 is a block diagram which shows a constitution of the inner circuit of the electronic range 15, 21 is a microcomputer, and 22 is a ROM (read only memory) of the microcomputer 21 wherein programs for control of the electronic range are stored. The numeral 23 is a timer, 24 is an operation part and 25 is an indicator which indicates several kinds of parameters such as heating times and the like.

FIG. 8 is a circuit drawing which shows the constitution of the microwave generation device 16 and a power supply circuit thereof, and **16*a* is a microwave generation part, 16*b* is a cathode heating coil for heating the cathode of the microwave generation part 16*a*, 16*c* is a high voltage generation coil for applying the high voltage to a plate of the microwave generation part 16*a*, and 31** is a fuse inserted into the power supply line.

Since the monitor switch 1, primary switch 2 and secondary switch 3 of the above conventional electronic range uses comparatively large current capacity switches respectively as much as at least 15 ampere, safety measures have to be taken. Particularly, in the electronic range for foreign countries, examinations of breaks, welding for said monitor switch 1, primary switch 2 and secondary switch 3 are obligated in order to satisfy the safety rules for sales such as the UL standards in the United States of America and the like at the time of shipment from factories.

This examination is performed respectively to said monitor switch 1, primary switch 2, and secondary switch 3 with two kinds of testers having a door hook form. The examination of the primary switch 2 is an examination for confirming that the microwave generation device 16 does not operate when the primary switch 2 is on by jig having said door-hook form. Further, the examination of the secondary switch 3 is an examination for confirming that the microwave generation device 16 does not operate when the secondary switch 3 is on by jig having said door-hook form. Still further, the examination of the monitor switch 1 is an examination for confirming that the power supply is burned out by operation of a break or fuse of the power with a jig having said door-hook form (the jig used in this case is a jig which makes the primary switch 2 on used at the time of examination of said primary switch 2 and a jig which makes the secondary switch 3 on and maintains the monitor switch 1 in closing state).

Since the conventional electronic range consists of the above, the examination at the time of the shipment from the factory must be performed by using not less than two kinds of jigs. Accordingly, it takes not only a long period of time for mounting or removing the jig, but also the examination process becomes complicated, including a decrease in safety and an increase in product cost.

In addition, since the switches which make up the interlocking switch circuit of the door use comparatively large current capacities such as 15A or so for driving the microwave generation device 16, a bold wire must be used, thereby causing a decrease in the safety of the electronic range due to proceeding of parts for large capacity switch mechanism and the corresponding increase in product costs.

3. SUMMARY OF THE INVENTION

This invention has been made to overcome the above problems and its object is to obtain an electronic range provided with an interlocking switch circuit having an improved examination efficiency and an improved safety at the time of opening and closing of the door.

The electronic range according to this invention is characterized by:

an electronic cooking range which is provided with: a microwave generation device for generation of a microwave, an interlocking circuit consisting of a monitor switch, primary switch and a secondary switch which are switched on/off by opening or closing of a door for control of operation/nonoperation of the microwave generation device; an operation part for setting the above various kinds of cooking parameters; an indicator which indicates various kind of cooking parameters set by the operation part; and a control part which controls said microwave generation device, operation part and indication part; and heats the food material by microwave heating; said electronic cooking range is characterized by: door switches which are switched on/off by opening or closing of the door; a second relay contact set is place on said secondary switch; a control means of the relay contact point which controls said secondary relay contact point based upon whether said door switch is on or off; a special mode transferring means for transferring said control means to the special mode; an outer relay contact point control means which turns the secondary relay contact point on/off by operation from the outside when said control means transfers to the special mode to the special mode transferring means; and an indication control means of the opening and closing state which distinguishes opening state and closing state of the door based upon on/off of said door switch and indicates the distinguished opening or closing state on an indicator.

In addition, the electronic cooking range according to this invention is provided with:

a microwave generation device for generation of a microwave;

an interlocking switch circuit which consists of a monitor switch, primary switch and a secondary switch which are on/off by opening or closing of a door for control of operation/nonoperation of the microwave generation device;

an operation part for setting the above various kinds of parameters;

an indication part which indicates various kinds of cooking parameters set by the operation part; and a control part which controls said microwave generation device, operation part and indication part; and heats the food material by microwave heating;

said electronic range is characterized by:

a monitor low capacity switch, a primary low capacity switch and a secondary low capacity switch having a lower current capacity respectively than said each switch which is arranged at each arranged position of each switch of said monitor, primary and secondary and are on/off by each door opening or closing mechanism;

a detection means of the on/off signal which detects the on/off signal due to the door opening mechanism of each low capacity of the monitor, primary and secondary; and a switch on/off control means which turns each switch of said monitor primary and secondary on/off based upon the on/off signal detected by the on/off signal detection means.

In the electronic range of this invention, since the on/off secondary relay contact point can be operated from outside by setting the secondary relay contact point in place of the secondary switch and transferring to the special mode, the jig for "on" of the secondary switch which was used at the time of the examination becomes unnecessary, and accordingly only one jig is necessary, whereby examination steps can be decreased. Accordingly, examination efficiency is improved by decreasing handle working, whereby the decrease in safety due to handling operation can be prevented.

In addition, in the electronic range of this invention, the on/off of each lower capacity switch due to the door opening and closing mechanism based upon the on/off signal detection means is detected and each switch of the primary, secondary and monitor to which the current source terminal is connected or shortened respectively is on/off due to switch on/off means based upon the detection signal thereof.

Further, in the electronic range of this invention, switching on/off of each low capacity 1 switch due to door opening and closing mechanism is detected by on/off signal detecting means, whereby each switch of the primary, secondary and monitor switch which connects or shortens to the current source terminal, is on/off by switch on/off control means based upon said detecting signal.

In the interlocking switch circuit as described above, since each monitor low capacity switch, primary low capacity switch and secondary low capacity switch having low current capacity arranged at the on/off position due to the door opening mechanism of the electronic range provided dependently from said electronic range door respectively can be used in place of the monitor, primary and secondary switches, the preparation cost thereof is decreased because a high safety low current capacity switch can be used and the switchboard also becomes cheap. In addition, since small capacity wiring materials connected to each low current capacity switch (monitor, primary and secondary), safety is improved in comparison to the use of bold wiring materials and the preparation cost thereof is also lowered. Further, the conventional three switches which turn the power supply source on/off can be collected on a control board at a most stable position in design and wired in the shortest distance. Accordingly, it is easy to prepare and improves the safety in design, thereby enabling cost decreases.

4. BRIEF DESCRIPTION OF THE DRAWINGS

5. DETAILED DESCRIPTION OF THE INVENTION

The preferred embodiment of this invention will be hereafter described with reference to the accompanying drawings.

Figure 1:
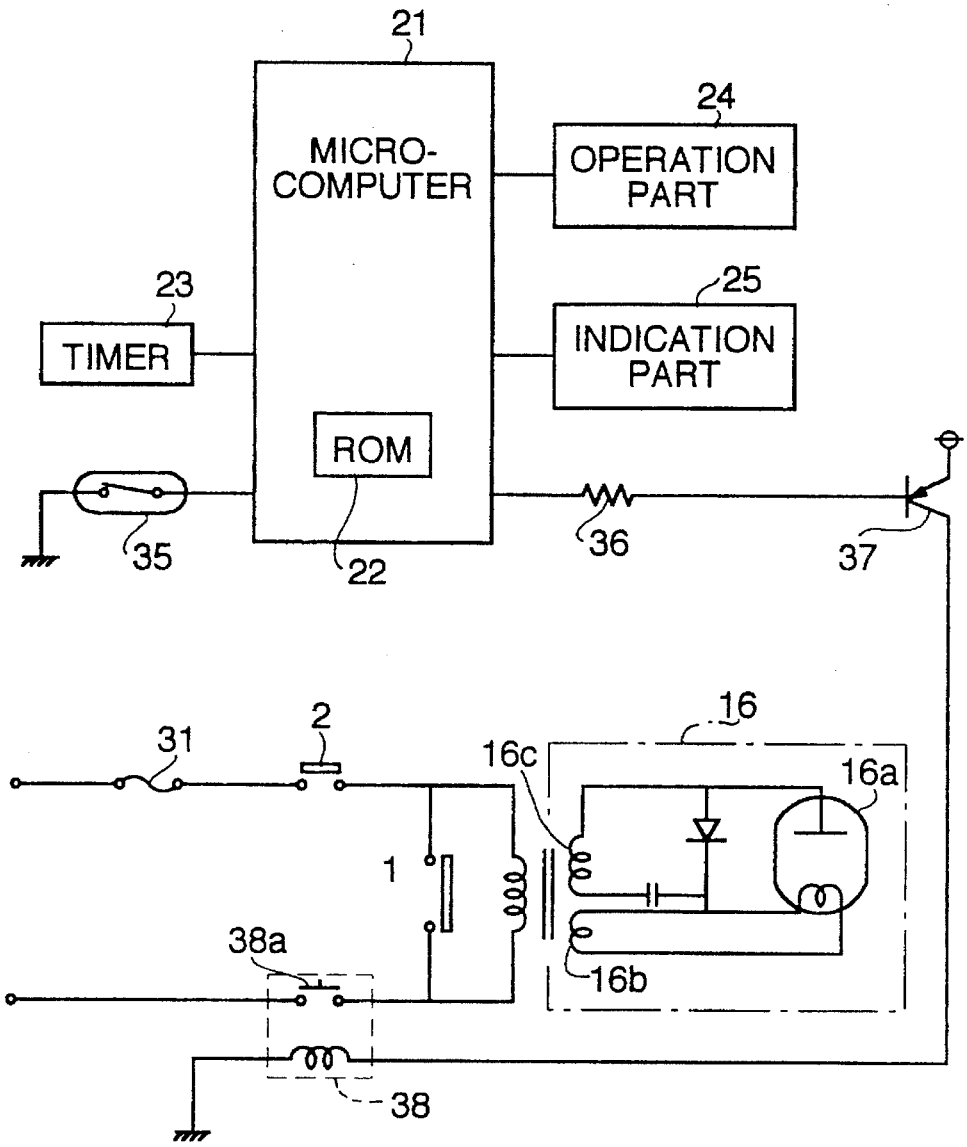
FIG. 1 is a circuit block diagram, which shows a configuration of the electronic circuit of the electronic range according to an embodiment of this invention.
Figure 2:
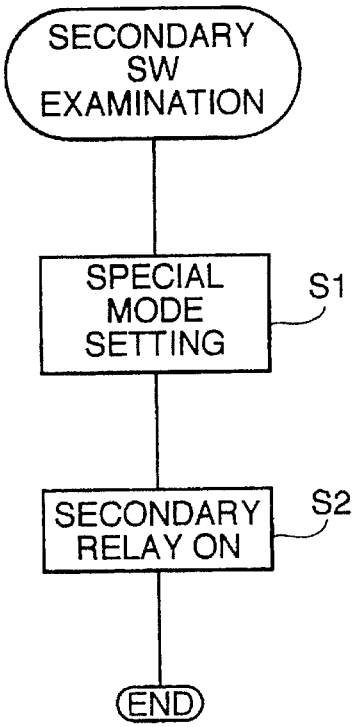
FIG. 2 is a block flow diagram which shows an examination of the secondary switch in the electronic range according to an embodiment of this invention.
Figure 3:
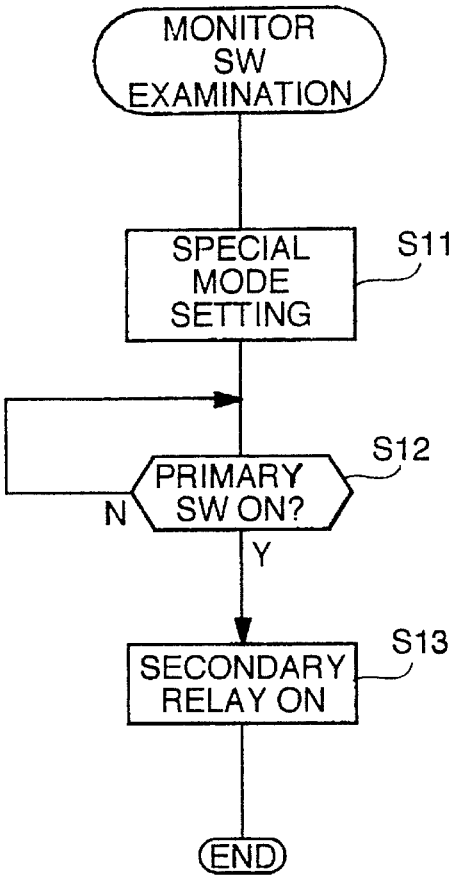
FIG. 3 is a block flow diagram which shows a detection of the monitor switch of the electronic range of an embodiment of this invention.
Figure 4:
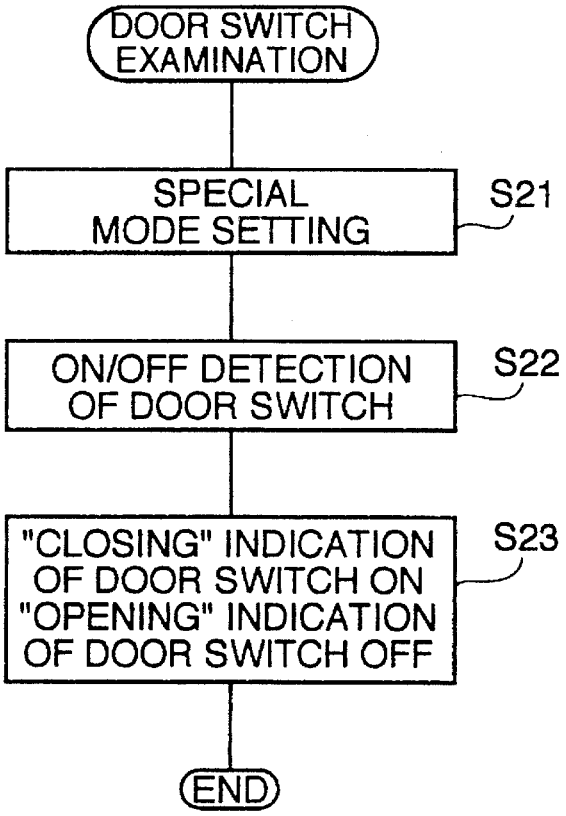
FIG. 4 is a flow diagram which shows a door switch of the electronic cooking range according to an embodiment of this invention.
Figure 7:
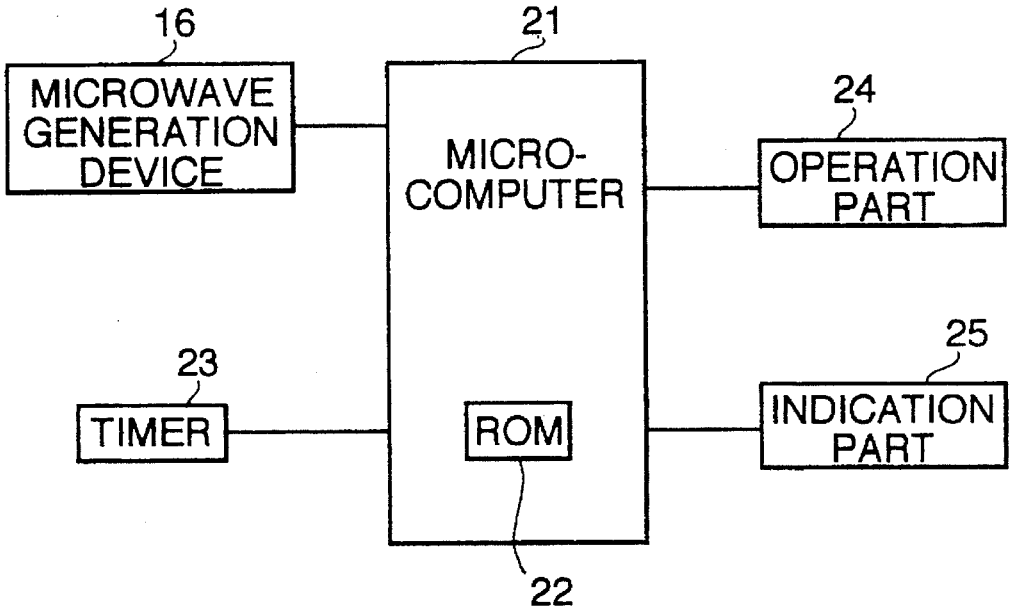
FIG. 7 is a clock diagram which shows an electronic circuit of the conventional electronic range.
Figure 8:
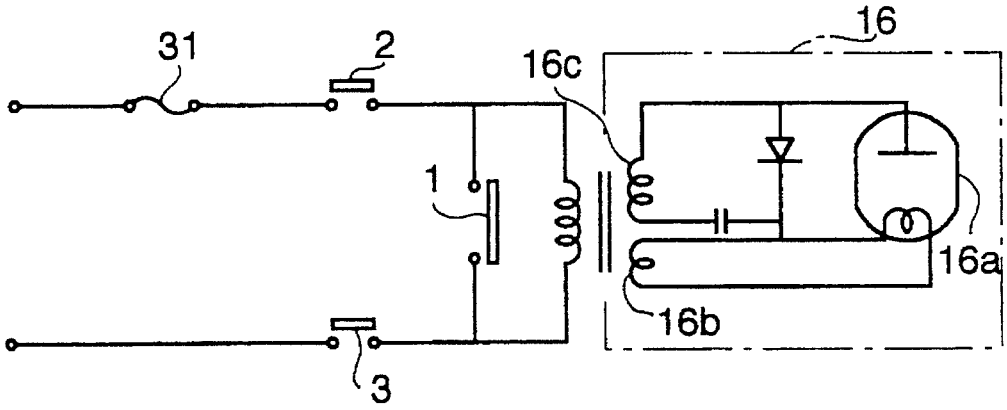
FIG. 8 is an electronic circuit diagram which shows a configuration of a microwave generation device and a power supply source thereof in the conventional electronic range.
Figure 9:
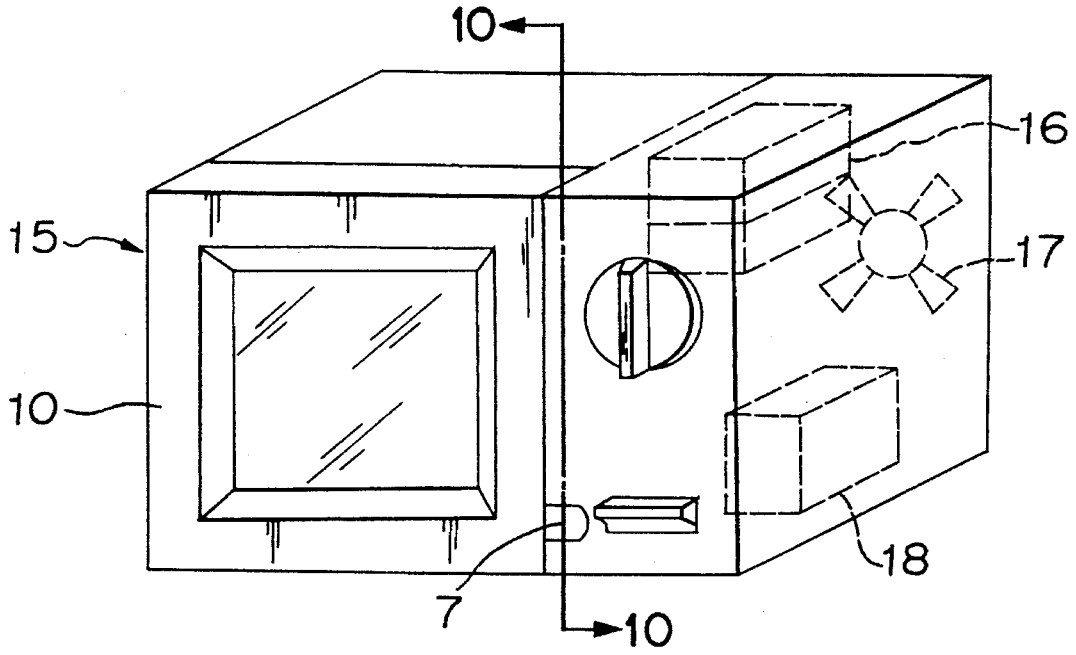
FIG. 9 PRIOR ART
FIG. 9 is a perspective view of a conventional electronic range.
Figure 10:
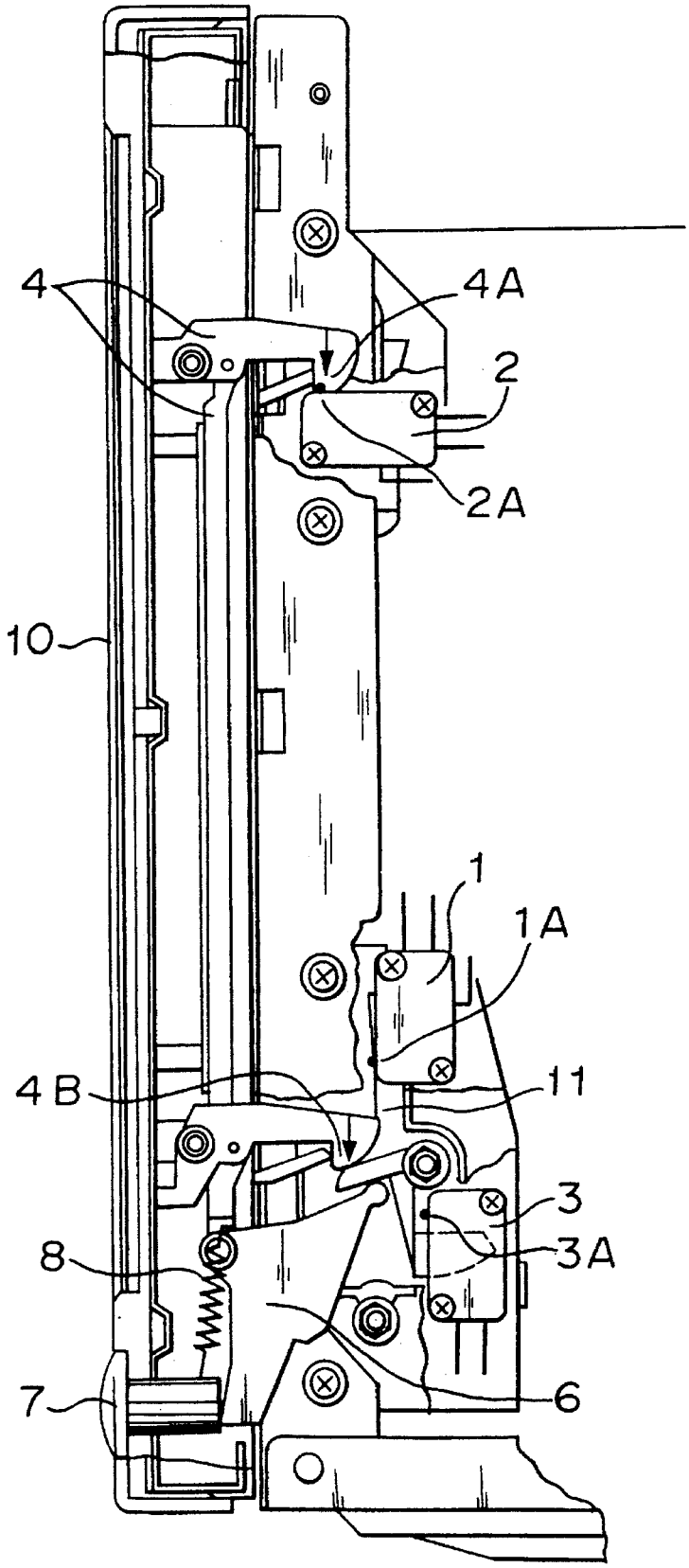
FIG.10 PRIOR ART
FIG. 10 is a sectional view taken on line 10—10 in the conventional electronic range shown in FIG. 9.

FIG. 1 is a block diagram which shows a configuration of an electronic circuit of the electronic range according to this embodiment. Parts in FIG. 1 which are substantially the same as those illustrated in FIG. 7 and FIG. 8 are shown with the same numbers in FIG. 7 and FIG. 8, but the explanations thereof are omitted. The numeral 35 is a door switch which detects the opening and closing of the door 10. The door switch 35 is connected to a fixed terminal of an input port (not shown) of the microcomputer 21 (control part, relay contact point control means, special mode transferring means, outside relay contact point control means, opening and closing state indicating control means). The block flow diagrams illustrated in FIG. 2 to FIG. 4 are stored in ROM (read only memory) 22 of the computer 21 as a program. The numeral 36 is a base current control resistance of a relay driving transistor 37. The numeral 38 is a secondary relay circuit, a contact point 38*a* of said secondary relay circuit 38 being used as a secondary switch. At normal use, a contact point 38a of the secondary relay circuit 38 is controlled by the microcomputer 21 so that it may be open when the door switch 35 detects the "opening" of the door 10, which may be closed when the door switch 35 detects the "closing" of the door 10.

The operation at the time of examination with regard to the monitor switch 1, primary switch 2 and secondary switch 3 (in this embodiment, a contact point 38*a* of the secondary relay circuit 38 of the electronic range of this embodiment) is described as follows.

FIG. 2 is a flow diagram which shows a detection of the secondary switch, FIG. 3 is a flow diagram which shows the detection of the monitor switch 1 and FIG. 4 is a flow diagram which shows a confirmation of the detection of the door switch.

The detection of the primary switch 2 is to confirm that the microwave generation device 16 does not operate when the primary switch 2 is on by means of jig having a form door hook.

Next, the examination of the secondary switch is described with reference to the flow diagram of FIG. 2. In step S1, a setting of the special mode is performed. The setting of this special mode is performed by the operation of a fixed key of an operation board 24. In the next step S2, an "on" instruction of the secondary relay 38 is input by another key operation of the operation part 24 and a coil of the secondary relay 38 is excited by a relay driving transistor 37, a contact point 38*a* of the secondary relay 38 thereby being closed. In this case, the "on" jig of the primary switch 2 is in a setting state and the fact that the microwave generation device 16 does not operate even if a contact point 38*a* of the secondary relay 38 is closed, must be confirmed. Accordingly, the jig is not used in this examination.

An examination of the monitor switch 1 is next described with reference to the flow diagram of FIG. 3. In step S11, the special mode is set. The set of this special mode is performed by the operation of a fixed key of the operating part the same as in step S1 of FIG. 2. In the next step S12, "on" or "off" of the primary switch 2 is judged by a jig having a door hook form. When the primary switch 2 is on, the coil of the secondary relay 38 is excited by the relay driving transistor 37 under a condition that "on" instruction of the secondary relay 38 is input by another key operation of the operation part 24 by further step 13, thereby a contact point 38*a* of the secondary relay 38 is closed. In this case, together with the confirmation that the "on" jig of the primary switch is in setting state and that the microwave generation device 16 does not operate because a contact point 38*a* of the secondary relay 38 is closed, the monitor switch 1, primary switch 2 and a contact point 38*a* of the secondary relay 38 do not weld, because fuse 31 is cut by melting, should be also confirmed.

Further, the examination of the door switch 35 will be described with reference to the flow diagram of FIG. 4. In step S21, a special mode is set. The setting of this special mode is performed by the operation of a fixed key of the operation part 24, the same as step S1 of FIG. 2. In the next step S22, the opening and closing of the door 10 is detected by the door switch 35 by opening and closing the door 10 and then opening and closing of the door 10 which is detected by the door switch 35 is distinguished in step S23 whereby "opening" sign or "closing" sign is indicated on the indicator 25 corresponding to the result distinguished. The indication "0000" means "opening" of the door 10 and the indication "1111" which means "closing" is indicated on the indicator at the special mode.

In this embodiment, as described above, since the secondary switch is constituted so as to be openable the "on/off" of a contact point 38*a* of the secondary relay 38 independently from outside by the secondary relay 38 independently from outside by transferring the ordinary mode to the special mode by the operation of a fixed key of the special board 24 at the time of the examination together with replacing the secondary switch to a contact point 38*a* of the secondary relay 38, such jigs as one for "on" of the conventional secondary switch and another one which maintains the monitor switch 1 closed together with "on" of the secondary switch 3, becomes unnecessary whereby the kinds of jigs used at the time of examination decrease to increase examination efficiency.

Although the opening and closing indication of the door in the above embodiment is shown by symbols or numeral values, the door opening or closing may be indicated by LCD (liquid crystal device) and the like in general.

An embodiment of this invention will be described with reference to the drawings as follows.

Figure 5:
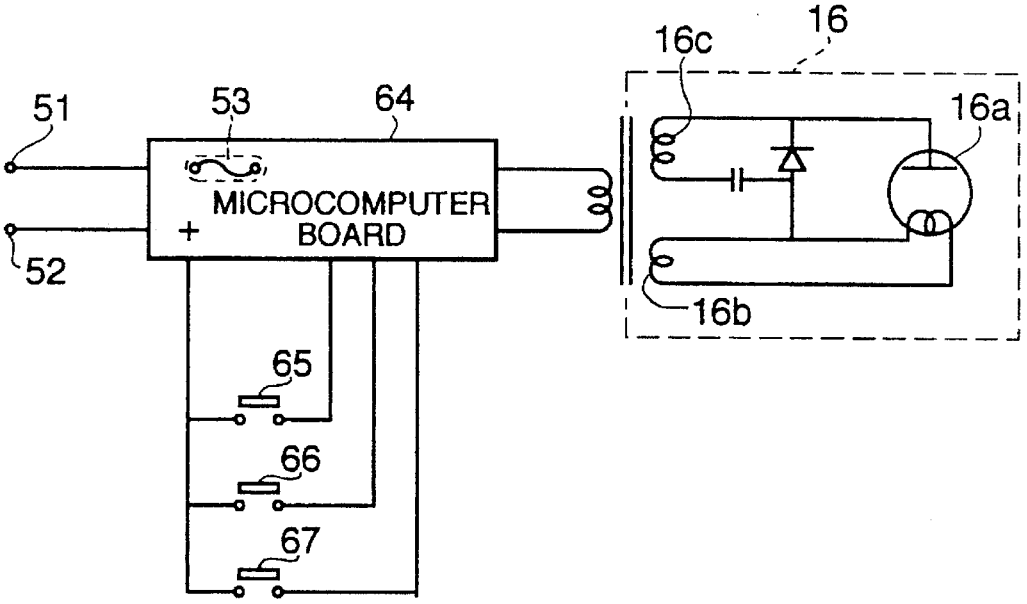
FIG. 5 is a concept view which shows an interlocking switch circuit of the electronic range according to an embodiment of this invention.

FIG. 5 is a concept view which shows interlocking switch circuit of the electronic range of this embodiment. In FIG. 5, the same or corresponding parts as in FIG. 8 are described with the same numbers and their descriptions are omitted. In FIG. 5, 64 is a microcomputer board and consists of a fuse 53, power supply connecting terminals 51, 52, source convention circuit (not shown) which converts an AC current source to a 5 volt DC source, CPU, ROM, RAM (random access memory), input port, output port, output terminal to the high frequency generation device 16, and the like. The numeral 65 is a small current capacity switch, such as a primary low current capacity of 100 mA or so, connected to the fixed port terminal of input port 64*a* of the microcomputer, and 66 and 67 are respectively a monitor low capacity switch and a secondary low capacity switch likewise. The primary low capacity switch 65, monitor low capacity switch 66 and secondary low capacity switch 67 are installed around the door (not illustrated) to the electronic range, these switches being on/off in a fixed switch opening order previously determined by the door opening mechanism described above.

The on/off signal detecting means consists of the primary low capacity switch 65, monitor low capacity switch 66, secondary low capacity switch 67 and a microcomputer 83 described hereafter.

Figure 6:
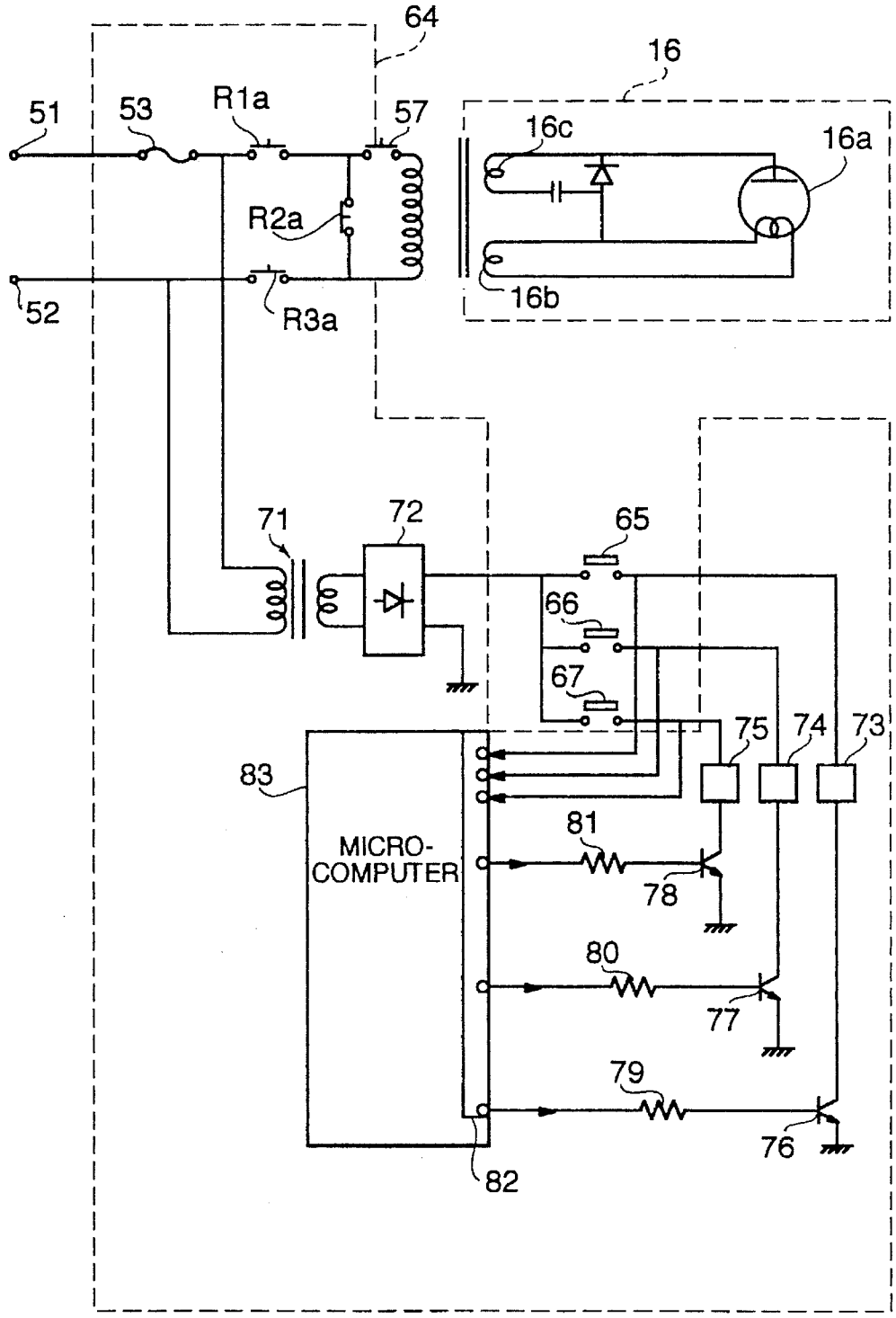
FIG. 6 is a schematic circuit wiring diagram which shows an embodiment configuration of the interlocking switch circuit in FIG. 5.

FIG. 6 is a schematic circuit wiring diagram of the interlocking switch circuit of the electronic range shown in FIG. 5. In FIG. 6, the same or the parts corresponding to FIG. 5 are described with the same numbers as in FIG. 5 and the descriptions thereof are omitted. In FIG. 6, 71 is a voltage drop transformer which converts the commercial AC power which connects source connecting terminals 51 and 52 to a lower AC power, and 72 is a diode bridge circuit which converts the output of the voltage drop transformer 71 to a direct current. The numeral 73 is a primary relay coil connected to the primary low capacity switch 65 in series, 74 is a monitor relay coil connected to the monitor low capacity switch 66 in series and 75 is a secondary relay coil which is connected to the secondary low capacity switch 67 in series. In addition, 76 is a transistor which excites the primary relay coil 73, 77 is a transistor which excites the monitor relay coil 74 and 78 is a transistor which excites the secondary relay coil 75. The numeral 79 is a resistance for controlling a base current which controls a base current of the transistor 76, 80 is a resistance for controlling transistor 77, and 81 is a resistance for controlling a base current which controls a base current of the transistor 78. The numeral 83 is a microcomputer, fixed terminals of an output port 82 of said microcomputer 83 being connected with each end of the resistance for said base current control 79, 80, and 81 respectively.

Numeral R1a is a primary relay contact point closed by excitation of the primary relay coil 73, R2b is a monitor relay contact point which becomes open by excitation of the monitor relay coil 74 and R3a is a secondary relay contact point closed by excitation of the secondary relay coil 75, the primary relay contact point R1a, monitor relay contact point R2a and secondary relay contact point R3a being provided with the same current capacity as conventional primary switch 2, monitor switch 1 and secondary switch 3, respectively.

The switch on/off control means consists of each relay contact point R1a, R2b, and R3a of the primary, monitor and secondary, and each relay coil 73, 74 and 75 thereof, and the microcomputer 83.

The operation is next described as follows.

In the interlocking switch circuit of this electronic range, when the door of the electronic range is opened or closed, the primary low capacity switch 65, monitor low capacity switch 66 and secondary low capacity switch 67 arranged at the door of the electronic range in a fixed order by opening and closing mechanism of the door is on/off, whereby this on/off signal input to the microcomputer 83 confirms the on/off of the primary low capacity switch 65, monitor low capacity switch 66 and secondary low capacity switch 67 having low current capacity arranged at the door of the electronic range. Since the relay contact point is controlled by on/off of these switches, and the interlocking switch circuit is constituted by this relay contact point, and a commercial AC power connects the power connecting terminals 51, 52 thereto and the microwave generation device 16 are controlled so as to be connected or cut off, the wiring materials for connecting to the primary low capacity switch 65, monitor low capacity switch 66 and secondary low capacity switch 67, respectively arranged at the door, have only to be a slender wiring material having a low capacity and the processing of the wiring material around the door of the electronic range is also simplified, whereby improvement in safety and a decrease in preparation costs due to a simplification in preparation can be obtained.

On the other hand, since there is no need to arrange the primary relay contact point R1a, monitor relay contact point R2b and secondary relay contact point R3a arranged the door of the electronic range having the same current capacity as conventional one and a bold wiring having a large current capacity can be wired at the shortest distance in the best position for safety whereby a mechanical design having a high safety can be obtained.

Furthermore, since the primary low capacity switch 65, monitor low capacity switch 66, secondary low capacity switch 67, and the primary relay coil 73, monitor relay coil 74, secondary relay coil 75 are connected respectively in series, the on/off state of the primary low capacity switch 65, monitor low capacity switch 66, and secondary low capacity switch 67 relate directly to the excitation conditions of the primary relay coil 73, monitor relay coil 74, secondary relay coil 75. Accordingly, this circuit has improved reliability and safety.

In this embodiment, although an example wherein a relay contact point and a relay coil are used as a switch on/off control means is illustrated, a switch on/off control means wherein a track and a photo-coupler are combined may be used in place of the relay contact point and the relay coil.

This invention provides the following effects.

Since the interlocking switch circuit of the electronic range is possible to turn on/off the secondary relay contact point from outside by providing the secondary relay contact point in place of the secondary switch, and further providing a special mode thereby transferring the ordinary mode to the above special mode, the jig "on" of the secondary switch is not necessary, whereby the use of jig at the time of the examination decreases to shorten the time of the examination step. Accordingly, examination efficiency is improved by the decrease of the handling operation thereby overcoming the reason of safety decrease.

In addition, according to this invention, since the primary low capacity switch, monitor low capacity switch and secondary low capacity switch having a low current capacity arranged at the door are on/off by the opening and closing mechanism of the door in the electronic range whereby the interlocking switch circuit can be constituted by three switches which perform the connection or the shortening of the power supply terminal at the safest position arranged independent from the door based upon the above signal. Accordingly, the processing of the wiring becomes easy and production labor can be lessened and the safety of the interlocking switch circuit can be improved by using a low capacity switch at the vicinity of the door.

What is claimed is:

1. In an improved electronic range, having a housing with a chamber for materials placed therein, and a door, for the microwave heating of said materials, such as food, and having a microwave generation device 16 for generating microwaves, and interlocking switch circuit including a monitor switch 1, a primary switch 2, and a secondary switch 3, which are of the on/off type by opening and closing of said door 10 for safely controlling the operation/non-operation of said microwave generation device 16, and operation part 24 for setting information, and indication part 25 for indicating said information set by said operation part 24, and a control part 21 for controlling said microwave generation device 16, said operation part 24, and said indication part 25, the improvement comprising:

a door switch 35 of the on/off type generated by opening and closing of said door 10;

a secondary relay contact point 38*a* located at a position analogous to where said secondary switch 3 of a conventional microwave oven is generally located; a relay control means for controlling the secondary relay contact point 38*a* based on the on/off operation of said door switch 35;

a special mode transferring means for transferring said control part 21 to the special mode transferring means;

a relay contact point control means for turning on/off said secondary relay contact point 38*a* by said control part 21, when said control part 21 is transferred to the special mode by said special mode transferring means; and indication control means for the opening and closing state of the opening and closing of said door which distinguishes the opening or closing state of the door based upon the on/off condition of said door switch 35 and for indicating said door's operational state to the indication part 25; whereby the use of special jigs for testing to check one or more switches is no longer required, and thus productivity in the manufacture of said electronic range is greatly improved.

2. In an improved electronic range having a housing with a chamber for materials placed therein, and a door, for the microwave heating of said materials, such as food, and having a microwave generation device 16 for generating microwaves, and interlocking switch circuit including a monitor switch, a primary switch, and a secondary switch, which are of the on/off type by opening and closing of said door 10 for safely controlling the operation/non-operation of said microwave generation device 16, and operation part 24 for setting information, and indication part 25 for indicating said information set by said operation part 24, and a control part 21 for controlling said microwave generation device 16, said operation part 24, and said indication part 25, the improvement comprising:

a monitor low capacity switch 66, a primary low capacity switch 65, and a secondary low capacity switch 67, each having a lower current capacity than each of said monitor, primary and secondary switches which are located generally near and inside of said door, and are operational by the on/off position by the opening and closing mechanism of said door 10;

an on/off signal detecting means for detecting an on/off signal of the door opening and closing mechanism of each of said low capacity monitor, primary and secondary switches; and a switch on/off control means for performing the on/off operation of said monitor, primary and secondary switches, based upon a detected on/off signal by the on/off signal detecting means.

* * * * *